US008457528B2

(12) United States Patent
Ochi et al.

(10) Patent No.: US 8,457,528 B2
(45) Date of Patent: Jun. 4, 2013

(54) ELECTROPHOTOGRAPHIC APPARATUS

(75) Inventors: Atsushi Ochi, Hino (JP); Harunobu Ogaki, Suntou-gun (JP); Hiroki Uematsu, Suntou-gun (JP); Yasuhiro Kawai, Susono (JP); Koji Takahashi, Suntou-gun (JP); Shio Murai, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/382,154

(22) PCT Filed: Aug. 27, 2010

(86) PCT No.: PCT/JP2010/065079
§ 371 (c)(1),
(2), (4) Date: Jan. 3, 2012

(87) PCT Pub. No.: WO2011/025061
PCT Pub. Date: Mar. 3, 2011

(65) Prior Publication Data

US 2012/0099898 A1 Apr. 26, 2012

(30) Foreign Application Priority Data

Aug. 31, 2009 (JP) ..... 2009-199499
Aug. 25, 2010 (JP) ..... 2010-188397

(51) Int. Cl.
*G03G 15/045* (2006.01)

(52) U.S. Cl.
USPC ..... 399/159; 430/66

(58) Field of Classification Search
USPC ..... 430/66; 399/159
See application file for complete search history.

(56) References Cited

U.S. PATENT DOCUMENTS 6,110,628 A 8/2000 Sekiya et al.
6,180,303 B1 1/2001 Uematsu et al.
6,372,397 B1 4/2002 Maruyama et al.

(Continued)

FOREIGN PATENT DOCUMENTS

CN 101375212 A 2/2009
JP 11-125918 A 5/1999

(Continued)

OTHER PUBLICATIONS

Chinese Office Action dated Nov. 22, 2012 in Chinese Application No. 201080038122.X.

(Continued)

*Primary Examiner* — Peter Vajda
(74) *Attorney, Agent, or Firm* — Fitzpatrick, Cella, Harper & Scinto

(57) ABSTRACT

An electrophotographic apparatus is provided including an electrophotographic photosensitive member which includes a surface protective layer; and an exposure device which irradiates a surface of the electrophotographic photosensitive member with an exposure beam so as to form an electrostatic latent image on the surface of the electrophotographic photosensitive member, wherein the surface protective layer includes a material having no structure to provide charge transporting performance and has a plurality of through holes penetrating from the side of the front surface of the surface protective layer to the side of the charge transport layer, and the thickness of the surface protective layer is from 0.1 μm or more to 1.5 μm or less, and wherein when the surface of the electrophotographic photosensitive member is irradiated with the exposure beam, two or more of the through holes are included in an exposure beam spot.

3 Claims, 3 Drawing Sheets

U.S. PATENT DOCUMENTS

| | | | |
|---|---|---|---|
| 6,416,915 | B1 | 7/2002 | Kikuchi et al. |
| 6,436,597 | B2 | 8/2002 | Maruyama et al. |
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |
| 7,045,261 | B2 | 5/2006 | Tanaka et al. |
| 7,186,489 | B2 | 3/2007 | Uematsu et al. |
| 7,226,711 | B2 | 6/2007 | Amamiya et al. |
| 7,364,824 | B2 | 4/2008 | Kikuchi et al. |
| 7,378,205 | B2 | 5/2008 | Sekiya et al. |
| 7,413,840 | B1 | 8/2008 | Ogaki et al. |
| 7,534,534 | B2 | 5/2009 | Nakata et al. |
| 7,551,878 | B2 | 6/2009 | Ogaki et al. |
| 7,553,594 | B2 | 6/2009 | Ogaki et al. |
| 7,556,901 | B2 | 7/2009 | Anezaki et al. |
| 7,563,553 | B2 | 7/2009 | Kikuchi et al. |
| 7,585,604 | B2 | 9/2009 | Ogaki et al. |
| 7,622,238 | B2 | 11/2009 | Uematsu et al. |
| 7,629,102 | B2 | 12/2009 | Ochi et al. |
| 7,645,547 | B2 | 1/2010 | Okuda et al. |
| 7,655,370 | B2 | 2/2010 | Kitamura et al. |
| 7,704,657 | B2 | 4/2010 | Uesugi et al. |
| 7,718,331 | B2 | 5/2010 | Uematsu et al. |
| 7,749,667 | B2 | 7/2010 | Kawahara et al. |
| 7,799,496 | B2 | 9/2010 | Uesugi et al. |
| 7,838,190 | B2 | 11/2010 | Ogaki et al. |
| 7,875,410 | B2 | 1/2011 | Ogaki et al. |
| 7,927,774 | B2 | 4/2011 | Ogaki et al. |
| 7,931,848 | B2 | 4/2011 | Ochi et al. |
| 2007/0015074 | A1* | 1/2007 | Sugino et al. ..... 430/59.6 |
| 2008/0096123 | A1 | 4/2008 | Shimada et al. |
| 2008/0304864 | A1 | 12/2008 | Kitamura et al. |
| 2009/0170023 | A1 | 7/2009 | Shimada et al. |
| 2010/0062171 | A1 | 3/2010 | Kaku et al. |
| 2011/0177438 | A1 | 7/2011 | Noguchi et al. |

FOREIGN PATENT DOCUMENTS

| | | | |
|---|---|---|---|
| JP | 11-237751 | A | 8/1999 |
| JP | 2001-166502 | A | 6/2001 |
| JP | 2005-241974 | A | 9/2005 |
| JP | 2007-233358 | A | 9/2007 |
| JP | 2008-203807 | A | 9/2008 |
| JP | 2009-25342 | A | 2/2009 |
| JP | 2009-31503 | A | 2/2009 |
| WO | 2007/088990 | A1 | 8/2007 |

OTHER PUBLICATIONS

PCT International Search Report and Written Opinion of the International Searching Authority, International Application No. PCT/JP2010/065079, Mailing Date Oct. 12, 2010.

* cited by examiner

ELECTROPHOTOGRAPHIC APPARATUS

TECHNICAL FIELD

The present invention relates to an electrophotographic apparatus.

BACKGROUND ART

In recent years, electrophotographic apparatuses typified by copiers and laser beam printers have been improved in various performance properties including operation speed and image quality, and it is desired to utilize electrophotographic apparatuses as printers capable of not only copying and outputting documents in offices but also outputting a large volume of high quality images. Therefore, great importance is attached to achieving both high image quality and high durability of electrophotographic apparatuses.

Here, when attention is focused on electrophotographic photosensitive members mounted in electrophotographic apparatuses, it is important that surface layers of the electrophotographic photosensitive members is made to provide charge transporting performance in order to attain high image quality of elecrophotographic apparatuses. For this reason, a charge transporting material is often incorporated into the surface layer of an electrophotographic photosensitive member. However, when a charge transporting material is incorporated into the surface layer of an electrophotographic photosensitive member, the mechanical strength of the surface layer degrades due to the plasticity of the charge transporting material, which may likely to cause a degradation in the running performance of the electrophotographic photosensitive member and the electrophotographic apparatus.

In the light of the above-mentioned circumstances, there have been studied materials for attaining both high charge transporting performance and high mechanical strength to surface layers of electrophotographic photosensitive members. Japanese Patent Application Laid-Open No. 2005-241974 discloses an electrophotographic photosensitive member having a surface layer formed using a resin excellent in mechanical strength. Japanese Patent Application Laid-Open No. H11-237751 discloses an electrophotographic photosensitive member having a surface layer formed by three-dimensionally crosslinking conductive particles and a curable compound. Japanese Patent Application Laid-Open No. 2001-166502 discloses an electrophotographic photosensitive member having a surface layer formed by three-dimensionally crosslinking a curable compound having a structure to provide charge transporting performance.

However, such electrophotographic apparatuses, in which an electrophotographic photosensitive member having the surface layer disclosed in Japanese Patent Application Laid-Open No. 2005-241974, Japanese Patent Application Laid-Open No. H11-237751 or Japanese Patent Application Laid-Open No. 2001-166502 is mounted, still leave room for further improvement from the viewpoint of achieving both high image quality and high durability.

CITATION LIST

Patent Literature

PTL 1: Japanese Patent Application Laid-Open No. 2005-241974

PTL 2: Japanese Patent Application Laid-Open No. H11-237751

PTL 3: Japanese Patent Application Laid-Open No. 2001-166502

SUMMARY OF INVENTION

An object of the present invention is to provide an electrophotographic apparatus achieving both high image quality and high durability.

The present invention is an electrophotographic apparatus including:

an electrophotographic photosensitive member which includes a support, a charge generation layer formed on the support and containing a charge generating material, a charge transport layer formed on the charge generation layer and containing a charge transporting material, and a surface protective layer formed on the charge transport layer; and an exposure device which irradiates a surface of the electrophotographic photosensitive member with an exposure beam based on image information so as to form an electrostatic latent image on the surface of the electrophotographic photosensitive member, wherein the surface protective layer comprises a material having no structure to provide charge transporting performance and has a plurality of through holes penetrating from the side of the front surface of the surface protective layer to the side of the charge transport layer, and the thickness of the surface protective layer is from 0.1 μm or more to 1.5 μm or less, and wherein when the surface of the electrophotographic photosensitive member is irradiated with the exposure beam, two or more of the through holes are included in an exposure beam spot.

The present invention can provide an electrophotographic apparatus achieving both high image quality and high durability.

Further features of the present invention will become apparent from the following description of exemplary embodiments with reference to the attached drawings.

DESCRIPTION OF EMBODIMENTS

Figure 1:
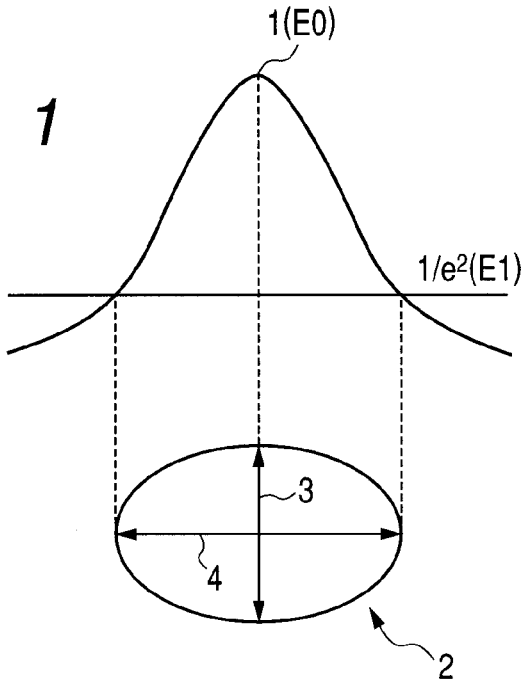
FIG. 1 is a conceptual diagram illustrating an example of an exposure beam spot.

An electrophotographic apparatus according to the present invention has an electrophotographic photosensitive member which has a support, a charge generation layer formed on the support and containing a charge generating material, a charge transport layer formed on the charge generation layer and containing a charge transporting material, and a surface protective layer formed on the charge transport layer; and an exposure device which irradiates a surface of the electrophotographic photosensitive member with an exposure beam based on image information so as to form an electrostatic latent image on the surface of the electrophotographic photosensitive member.

First, the following describes the surface protective layer of the electrophotographic photosensitive member.

A surface protective layer of the electrophotographic photosensitive member for use in the electrophotographic apparatus of the present invention (hereinafter, otherwise referred to as "surface protective layer according to the present invention") has a plurality of through holes penetrating from the side of the front surface of the surface protective layer to the side of the charge transport layer.

In the present invention, the size, the number and the arrangement of the through holes and the size and exposed area (image forming area) of the spot of exposure beam are set so that two or more of through holes are always included in the spot of exposure beam applied on a surface of the electrophotographic photosensitive member wherever the spot of exposure beam (exposure beam spot) is located in an image forming area of the surface of the electrophotographic photosensitive member. As a result, a number of through holes are present in the image forming area of the surface of a surface protective layer according to the present invention, although the number of through holes varies depending on the size thereof.

In the surface protective layer according to the present invention, preferably, 15 or more through holes are present, and more preferably 35 or more through holes are present, per 100 μm square (10,000 $\mu m^2$) in an image forming area (an area irradiated with an exposure beam) of the surface protective layer.

Further, in the present invention, the thickness of surface protective layer is from 0.1 μm or more to 1.5 μm or less, and more preferably from 0.3 μm or more to 1.0 μm or less. The thickness of the surface protective layer is less than 0.1 μm, the mechanical strength of the surface protective layer decreases, and the electrophotographic photosensitive member and electrophotographic apparatus are liable to decrease in running performance. When the thickness of the surface protective layer is more than 1.5 μm, the electrical properties of the surface protective layer degrade, and thus the image quality of output images is liable to lower.

Meanwhile, in formation of the surface protective layer according to the present invention, no charge transporting material having plasticity is used, and only a material having no structure to provide charge transporting performance is used. Therefore, it is possible to prevent decrease in mechanical strength of the surface protective layer and to improve the running performance of the electrophotographic photosensitive member and electrophotographic apparatus, as compared to the case of forming a surface protective layer using a charge transporting material having plasticity. Further, in the surface protective layer according to the present invention, a plurality of through holes are present, and proper electrical properties can be ensured by virtue of a charge transport layer exposed in openings of these through holes, and thus degradation in image quality of output images can also be prevented.

In the present invention, the charge transporting performance of the surface protective layer and charge transport layer is associated with a property that is represented by a degree of charge transfer [$cm^2/V\cdot s$] obtained when the energy (electric field strength) is $2.5\times10^5$V/cm, which is calculated from an initial surface potential decay curve measured by the xerographic time of flight (X-TOF) technique. The higher the value of a degree of charge transfer, the higher the charge transporting performance. However, when a plurality of through holes are present in a surface protective layer, the degree of charge transfer of the surface protective layer is difficult to measure using the X-TOF. Then, when a plurality of through holes are present in a surface protective layer, a sample film (layer) is separately prepared which is made of the same material as that for the surface protective layer and has the same thickness as that of the surface protective layer but has no through hole therein to measure a degree of charge transfer of the film according to the above manner, and the measured result is given as the degree of charge transfer of the surface protective layer. The surface protective layer according to the present invention is a layer which is substituted of a material having no structure to provide charge transporting performance, and thus, when attempts are made to measure a degree of charge transfer thereof by the X-TOF, accurate measurement is difficult because the degree of charge transfer is too small. The surface protective layer according to the present invention having such a small degree of charge transfer that is difficult to measure even when attempts are made to measure the degree of charge transfer according to the manner as described above can be regarded as a layer having no charge transporting performance. Specifically, when the value of a degree of charge transfer of a layer is smaller than the lower limit value ($1.0\times10^{-8}$ $cm^2/V\cdot s$), which is determined by the measurement method of degree of charge transfer used in the present invention, the layer is regarded as a layer having no charge transporting performance.

The through holes possessed by the surface protective layer according to the present invention can be observed, for example, with a commercially available laser microscope, optical microscope, electron microscope, and atomic force microscope.

Examples of the laser microscope include an ultra-depth shape measuring microscope VK-8550, an ultra-depth shape measuring microscope VK-9000 and an ultra-depth shape measuring microscope VK-9500 (all manufactured by Keyence Corporation); a surface shape measuring system Surface Explorer SX-520DR model instrument (manufactured by Ryoka Systems Inc.), a confocal scanning laser microscope OLS3000 (manufactured by Olympus Corporation), and a real color confocal microscope optics C130 (manufactured by Lasertec Corporation).

Examples of the optical microscope include a digital microscope VHX-900, a digital microscope VHX-500 and a digital microscope VHX-200 (all manufactured by Keyence Corporation), and a 3D digital microscope VC-7700 (manufactured by Omron Corporation).

Examples of the electron microscope include a 3D real surface view microscope VE-9800 and a 3D real surface view microscope VE-8800 (both manufactured by Keyence Corporation), a scanning electron microscope Conventional/Variable Pressure SEM (manufactured by SII Nano Technology Inc.), and a scanning electron microscope SUPERSCAN SS-55 (manufactured by Shimadzu Corporation).

Examples of the atomic force microscope include a nanoscale hybrid microscope VN-8000 (manufactured by Keyence Corporation), a scanning probe microscope NANONAVI STATION (manufactured by SII Nano Technology Inc.), and a scanning probe microscope SPM-9600 (manufactured by Shimadzu Corporation).

In the present invention, through holes were observed by an ultra-depth shape measuring microscope (VK-9500, manufactured by Keyence Corporation) to determine the maximum diameter, minimum diameter and depth of the through holes in the measured view. More specifically, the surface of the electrophotographic photosensitive member (the surface of the surface protective layer) was observed at three points of positions 50 mm away from both ends of the electrophotographic photosensitive member and the center portion of the electrophotographic photosensitive member. Here, the location of the three points for the observation was determined so that the three points were present on the same straight line along with the axial direction (the direction perpendicular to the circumferential direction) of the electrophotographic photosensitive member. Maximum diameters, minimum diameters and depths of the observed through holes were measured using an analysis program, and then average values thereof were calculated.

Note that the maximum diameter and the minimum diameter of a through hole mean a maximum diameter and a minimum diameter of the shape of a through hole (the surface shape of the through hole (the shape of an opening)) when observed from the side of the front surface of the electrophotographic photosensitive member. When the surface shape of a through hole is sandwiched by two parallel lines, the interval (distance) between the two parallel lines that are separated most from each other is a maximum diameter of the through hole; and the interval (distance) between the two parallel lines that are closest to each other is a minimum diameter of the through hole. For example, when the surface shape of a through hole is a square, the maximum diameter of the through hole is a length of a diagonal of the square, and the minimum diameter thereof is a length of one side of the square. When the surface shape of a through hole is a circle, both the maximum diameter and the minimum diameter of the through hole are a diameter of the circle. When the surface shape of a through hole is an ellipse, the maximum diameter of the through hole is a maximum diameter of the ellipse, and the minimum diameter thereof is a minimum diameter of the ellipse.

Next, the following describes the exposure device.

An exposure device for use in the electrophotographic apparatus of the present invention may be an exposure device which irradiates the surface of an electrophotographic photosensitive member with an exposure beam based on image information. For example, the exposure device may be an exposure scanning optical system using a semiconductor laser, and may be a stationary optical device using a LED, a liquid crystal shutter, an organic EL, etc. An exposure beam emitted from such an exposure device generally has a light intensity distribution in the form of Gaussian distribution or Lorentz distribution. The exposure beam spot in the present invention means a portion of a spot area defined from a maximum value 1 (E0) to the portion where the beam intensity decreases to $1/e^2$ (E1) in an exposure beam intensity distribution as illustrated in FIG. 1. As illustrated in FIG. 1, in a diameter of exposure beam spot 2, generally, a minimum diameter (minor axis diameter) 3 and a maximum diameter (major axis diameter) 4 are present.

As described above, the electrophotographic apparatus of the present invention is an electrophotographic apparatus adapted such that two or more through holes formed in the surface protective layer of the electrophotographic photosensitive member are included in the spot of exposure beam emitted from the exposure device onto the surface of the electrophotographic photosensitive member. When only one through hole is included in the spot of exposure beam, and when an image with a given solid area is intended to be output or when a thin line is intended to be output, the arranged state of through holes is reflected on the output image, and thus the image quality of the output image degrades. In other words, this causes image defects, for example, the given image area is not completely solid, or the thin line is broken in the middle or uneven. On the contrary, in the present invention, since two or more through holes are included in an exposure beam spot, an electrostatic latent image formed on the surface of the electrophotographic photosensitive member by irradiation with an exposure beam is improved in the accuracy. Thus, such image defects can be prevented from occurring, and the image quality of output images can be improved. Note that, in order to further improve the accuracy of an electrostatic latent image, the number of through holes included in an exposure beam spot may preferably be increased to 5 or more. Further, when a maximum diameter of each of the through holes formed in the surface protective layer of the electrophotographic photosensitive member is represented by A [μm] and a minimum diameter of the exposure beam spot is represented by B [μm], A [μm] and B [μm] may preferably satisfy a relationship represented by the following Expression (1).

$$1 \leqq A \leqq B \times 0.4 \quad (1)$$

Figure 8:
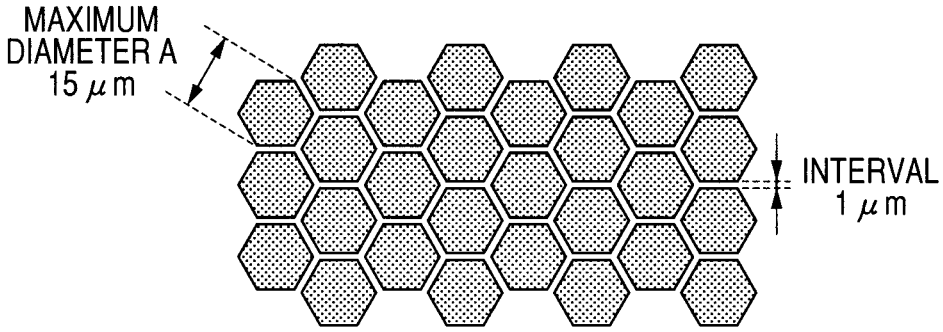
FIG. 8 is a partially enlarged diagram illustrating an array pattern of through holes formed in a surface protective layer of the electrophotographic photosensitive member of Example 2.
Figure 9:
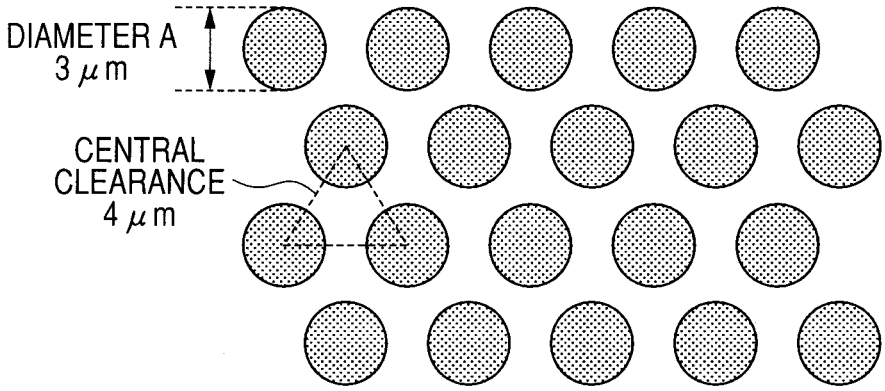
FIG. 9 is a partially enlarged diagram illustrating an array pattern of through holes formed in a surface protective layer of the electrophotographic photosensitive member of Example 17.

A specific example satisfying the above-mentioned condition will be described with reference to FIGS. 1 and 8. As illustrated in FIG. 8, when an exposure beam is applied to the surface of an electrophotographic photosensitive member having a surface protective layer in which regular hexagonal column-shaped through holes each having a maximum diameter A of 15 μm are arranged at an opposite interval of 1 μm so that a minimum diameter B (FIG. 1) of the exposure beam spot is 40 μm and a maximum diameter of the exposure beam spot is 50 μm, five or more of the through holes are included in the exposure beam spot. Also in this case, the relationship represented by Expression (1) is satisfied. Further, as illustrated in FIG. 9, also in the case of using an electrophotographic photosensitive member having a surface protective layer in which cylindrical-shaped through holes each having a diameter of 3 μm are arranged with a central clearance of 4 μm, the same result is obtained.

Next, the following describes the construction of an electrophotographic photosensitive member for use in the electrophotographic apparatus of the present invention.

An electrophotographic photosensitive member for use in the electrophotographic apparatus of the present invention includes a support, a charge generation layer formed on the support, a charge transport layer formed on the charge generation layer, and a surface protective layer formed on the charge transport layer. In the surface protective layer, a plurality of through holes penetrating from the side of the front surface of the surface protective layer to the side of the charge transport layer are present.

Figure 2:
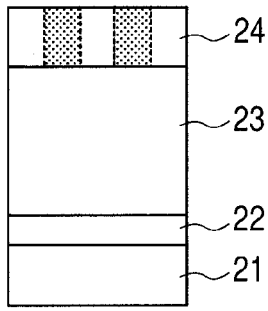
FIG. 2 is a diagram illustrating an exemplary layer construction of an electrophotographic photosensitive member.
Figure 3:
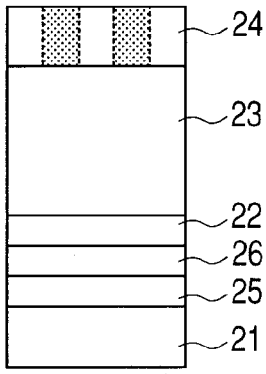
FIG. 3 is a diagram illustrating another exemplary layer construction of an electrophotographic photosensitive member.

FIGS. 2 and 3 each illustrate an exemplary layer construction of an electrophotographic photosensitive member.

An electrophotographic photosensitive member having a layer construction illustrated in FIG. 2 has a support 21, and a charge generation layer 22, charge transport layer 23 and a surface protective layer 24 that are provided in this order on the support 21.

In addition, as illustrated in FIG. 3, a conductive layer 25 for suppressing interference fringes and covering defects in the surface of the support 21, and an undercoating layer 26 having a barrier function (otherwise called "an intermediate layer" or "a barrier layer") may be provided between the support 21 and the charge generation layer 22.

As the support, a support having conductivity (conductive support) is preferable. For example, a support made of a metal, such as aluminum, aluminum alloy and stainless steel, can be used. In the case of a support made of aluminum or aluminum alloy, the following can be used: an ED tube, an EI tube or such tubes which have been subjected to cutting, electrolytic composite polishing, or a wet or dry honing. Examples of the shape of the support include a cylindrical shape and a belt shape.

A conductive layer intended to cover defects (scratches, etc.) on the surface of the support may be provided on the support.

The conductive layer can be formed as follows: conductive particles, a binder resin and a solvent are dispersed to obtain a conductive layer coating liquid, and the conductive layer coating liquid is applied onto the support, followed by drying (curing).

Examples of the solvent include ether-based solvents such as tetrahydrofuran, and ethylene glycol dimethylether; alcohol-based solvents such as methanol; ketone-based solvents such as methylethylketone; and aromatic hydrocarbon solvents such as methylbenzene.

Examples of a conductive powder include carbon black, acetylene black; metal particles such as aluminum, nickel, iron, nichrome, copper, zinc, and silver; and metal oxide particles such as tin oxide, and ITO.

Examples of the binder resin for use in the conductive layer include polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyarylate resin, phenoxy resin, polycarbonate, cellulose acetate resin, ethylcellulose resin, polyvinyl butyral, polyvinyl formal, polyvinyl toluene, poly-N-vinyl carbazole, acrylic resin, silicone resin, epoxy resin, melamine resin, urethane resin, phenol resin, and alkyd resin.

The thickness of the conductive layer is preferably from 5 μm or more to 40 μm or less, and more preferably from 10 μm or more to 30 μm or less.

An undercoating layer having a barrier function (electrical barrier properties) may be provided on the support or the conductive layer.

The undercoating layer can be formed as follows: a resin (binder resin) is dissolved in a solvent to obtain an undercoating layer coating liquid, and the undercoating layer coating liquid is applied onto the support or conductive layer, followed by drying.

Examples of the binder resin for use in the undercoating layer include polyvinyl alcohol, polyvinyl methyl ether, polyacrylic acid, methyl cellulose, ethyl cellulose, polyglutamic acid, casein, polyamide, polyimide, polyamideimide, polyamide acid, melamine resin, epoxy resin, polyurethane, and polyglutamate ester. Among these resins, polyamide is favorably used from the viewpoint of electrical barrier properties, coatability, and adhesion.

The thickness of the undercoating layer is preferably from 0.1 μm or more to 2.0 μm or less.

Semiconductive particles and an electron transporting material may be incorporated into the undercoating layer to prevent the flow of charge (carriers) from being disrupted in the undercoating layer.

A charge generation layer containing a charge generating material is provided on the support, the conductive layer or the undercoating layer.

The charge generation layer can be formed as follows: a charge generating material, a binder resin and a solvent are dispersed to obtain a charge generation layer coating liquid, and the charge generation layer coating liquid is applied onto the support, conductive layer or undercoating layer, followed by drying. Examples of the dispersing method include a method using a homogenizer, an ultrasonic wave, a ball mill, a sand mill, an attritor, a roll mill, etc. A proportion (P:B) of a charge generating material (P) to a binder resin (B) is preferably in the range of 10:1 to 1:10 (mass ratio), and more preferably in the range of 3:1 to 1:1 (mass ratio).

Examples of the charge generating material include azo pigments such as monoazo, disazo and trisazo; phthalocyanine pigments such as metal phthalocyanine and non-metal phthalocyanine; indigo pigments such as indigo and thioindigo; perylene pigments such as perylene acid anhydride and perylene acid imide; polycyclic quinone pigments such as anthraquinone and pyrenequinone; squarylium dye; pyrylium salt, thiapyrylium salt; triphenylmethane dye; inorganic materials such as selenium, selenium-tellurium and amorphous silicon; quinacridone pigment; azulenium salt pigment; cyanine dye; xanthene dye; quinonimine dye; styryl dye; and styryl dye. These charge generating materials may be used alone or in combination. Among these, from the viewpoint of sensitivity, metal phthalocyanine such as oxytitanium phthalocyanine, hydroxygallium phthalocyanine, chlorogallium phthalocyanine are preferably used.

Examples of the binder resin for use in the charge generation layer include polycarbonate, polyester, polyarylate, butyral resin, polystyrene, polyvinyl acetal, diallyl phthalate resin, acrylic resin, methacrylic resin, vinyl acetate resin, phenol resin, silicone resin, polysulfone, a styrene-butadiene copolymer, alkyd resin, epoxy resin, urea resin, and a vinyl chloride-vinyl acetate copolymer. Among these, butyral resins are preferably used. These binder resins may be used alone or in combination as a mixture or a copolymer.

Examples of the solvent for use in the charge generating layer coating liquid include an alcohol-based solvent, a sulfoxide-based solvent, a ketone-based solvent, an ether-based solvent, an ester-based solvent, and an aromatic hydrocarbon solvent.

The thickness of the charge generation layer is preferably from 0.05 μm or more to 5 μm or less, and more preferably from 0.1 μm or more to 2 μm or less.

In addition, sensitizers, antioxidants, ultraviolet absorbers, plasticizers etc. may be incorporated into the charge generation layer. Further, an electron transporting material may be incorporated into the charge generation layer to prevent the flow of charge (carriers) from being disrupted in the charge generating layer.

A charge transport layer containing a charge transporting material is provided on the charge generation layer.

The charge transport layer can be formed as follows: a charge transporting material and a binder resin are dissolved in a solvent to obtain a charge transport layer coating liquid, and the charge transport layer coating liquid is applied onto the charge generation layer, followed by drying. A proportion (D:B) of a charge transporting material (D) to a binder resin (B) is preferably in the range of 2:1 to 1:2 (mass ratio).

Examples of the charge transporting material include triaryl amine compounds, hydrazone compounds, styryl compounds, stilbene compounds, pyrazoline compounds, oxazole compounds, thiazole compounds, and triallylmethane compounds. These charge transporting materials may be used alone or in combination.

Example of the binder resin for use in the charge transport layer include polycarbonate, polyester, polyarylate, butyral resin, polystyrene, polyvinyl acetal, diallyl phthalate resin, acrylic resin, methacrylic resin, vinyl acetate resin, phenol resin, silicone resin, polysulfone, a styrene-butadiene copolymer resin, alkyd resin, epoxy resin, urea resin, and a vinyl chloride-vinyl acetate copolymer. Among these, polycarbonate and polyarylate are preferably used. These binder resins may be used alone or in combination as a mixture or a copolymer.

Examples of the solvent for use in the charge transport layer coating liquid include an alcohol-based solvent, a sulfoxide-based solvent, a ketone-based solvent, an ether-based solvent, an ester-based solvent, and an aromatic hydrocarbon solvent.

The average thickness of the charge transport layer is preferably from 5 μm or more to 40 μm or less, and more preferably from 10 μm or more to 30 μm or less.

A surface protective layer constituted of a material having no structure to provide charge transporting performance is provided on the charge transport layer.

In the surface protective layer, as a material (binder material) for forming the layer, resins such as thermoplastic resins (e.g. polycarbonate, polyester, and polyarylate), and curable resins (e.g. (meth)acrylic resin, phenol resin, silicone resin, and epoxy resin) can be used.

When the resin is a thermoplastic resin, the surface protective layer can be formed as follows: the resin is dissolved in a solvent to obtain a surface protective layer coating liquid, the surface protective layer coating liquid is applied onto the charge transport layer, followed by drying.

When the resin is a curable resin, the surface protective layer can be formed as follows: a surface protective layer coating liquid containing a compound having a polymerizable functional group is applied onto the charge transport layer, and then subjected to heating or irradiation with an ultraviolet ray or radiation ray so as to polymerize and cure the compound having a chain-polymerizable functional group. As the radiation ray, y-ray, an electron beam etc. can be used. It is, however, preferable to use an electron beam. Examples of the polymerizable function group include chain-polymerizable functional groups such as (meth)acrylic group, and epoxy group.

As a method of forming through holes in the surface protective layer, the following methods are exemplified.

Through holes in the surface protective layer can be formed using laser ablation or photolithography. Such through holes can also be formed by dew condensation after applying the surface protective layer coating liquid onto the charge transport layer under a high-humidity environment. In addition, a surface protective layer coating liquid, in which a mixed solvent using a hydrophobic solvent and a hydrophilic solvent having a boiling point higher than that of the hydrophobic solvent is contained, is applied onto the charge transport layer, and through holes can be formed by dew condensation.

Next, a construction of the electrophotographic apparatus of the present invention will be described.

Figure 4:
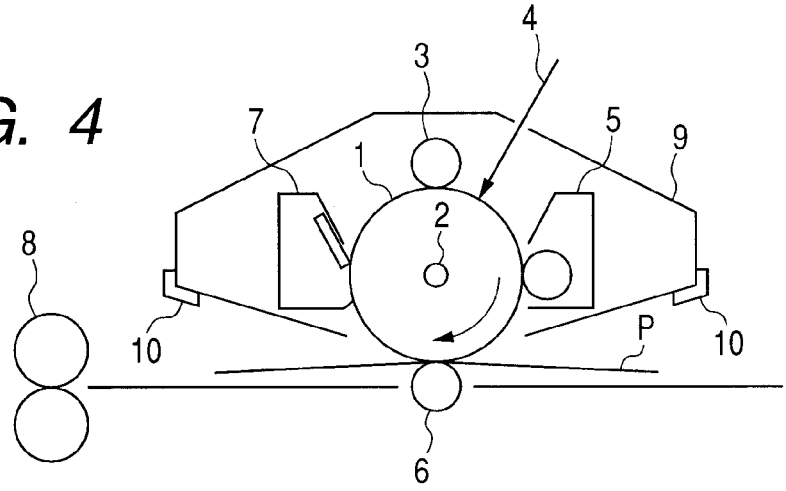
FIG. 4 is a diagram illustrating an exemplary construction of an electrophotographic apparatus.

FIG. 4 illustrates a schematic construction of an electrophotographic apparatus equipped with a process cartridge having an electrophotographic photosensitive member.

In FIG. 4, reference numeral 1 designates a cylindrical-shaped electrophotographic photosensitive member, which is driven to rotate around a shaft 2 at a predetermined circumferential velocity in a direction indicated by the arrow.

The electrophotographic photosensitive member 1 driven to rotate is uniformly charged with a predetermined positive or negative potential on its surface by a charging unit (primary charging unit: a charging roller, etc.) 3 during rotation. Then, the surface of the electrophotographic photosensitive member 1 is irradiated with an exposure beam (image exposure beam) 4 emitted from an exposure device (not illustrated) based on intended image information. Thus, an electrostatic latent image corresponding to intended image information is formed on the surface of the electrophotographic photosensitive member 1.

The electrostatic latent image thus formed on the surface of the electrophotographic photosensitive member 1 is developed with a toner by a developing unit 5 to form a toner image. Subsequently, the toner image thus formed on the surface of the electrophotographic photosensitive member 1 is transferred onto a transfer material (such as paper) P by a transfer bias from a transfer unit (a transfer roller, etc.) 6. The transfer material P is fed from a transfer material feeding unit (not illustrated) and taken to a contact portion between the electrophotographic photosensitive member 1 and the transfer unit 6 in synchronization with the rotation of the electrophotographic photosensitive member 1.

The transfer material P bearing the toner image on a surface thereof is separated from the surface of the electrophotographic photosensitive member 1 and is guided to a fixing unit 8 to be subjected to image fixation, whereby the transfer material P is printed out outside an apparatus as an image-formed matter (print, copy, etc.).

The surface of the electrophotographic photosensitive member 1 after transfer of an image to the transfer material P is cleaned by a cleaning unit (cleaning blade, etc.) 7 to remove residual toner (untransferred toner) remaining on its surface. Furthermore, the surface of the electrophotographic photosensitive member 1 is exposed to pre-exposure light (not illustrated) from the pre-exposure device (not illustrated) for diselectrification, and thereafter, it is repeatedly used for image formation. In the case where the charging unit 3 is a contact charging unit using a charging roller, the pre-exposure is not necessarily required.

In the present invention, two or more components selected from the electrophotographic photosensitive member 1, the charging unit 3, the developing unit 5, the transfer unit 6, and the cleaning unit 7 may be accommodated in a container to be integrated as a process cartridge. The process cartridge may be detachably mounted to an electrophotographic apparatus main body such as a copier and a laser beam printer. In FIG. 4, the electrophotographic photosensitive member 1, the charging unit 3, the developing unit 5, and the cleaning unit 7 are integrally supported to constitute a process cartridge 9, which is detachably mounted to an electrophotographic apparatus main body using a guide unit 10 (a rail, etc.) of the electrophotographic apparatus main body. Note that as the cleaning unit 7, a cleaning blade is generally used, however, a fur blush, magnetic brush, etc. may be used.

Hereinafter, the present invention will be further described in detail with reference to specific Examples, which, however, shall not be construed as limiting the scope of the present invention. Note that in the following Examples and Comparative Examples, the term "parts" means "parts by mass", "Mw" means "weight average molecular weight (Mw)", and "Mv" means "viscosity average molecular weight (Mv)".

Example 1

An aluminum cylinder having a diameter of 84 mm and a length of 370.0 mm, a surface of which was subjected to surface cutting treatment, was used as a support (cylindrical-shaped conductive support).

Next, 6.6 parts of titanium oxide particles, serving as conductive particles, coated with an oxygen-deficient tin oxide (powder resistivity: 80 Ω·cm; coverage with the oxygen-deficient tin oxide (mass ratio): 50% by mass), 5.5 parts of a phenol resin serving as a binder resin (trade name: PLYHOFEN J-325, produced by Dainippon Ink and Chemicals Industries Co., Ltd., resin solid content: 60% by mass), and 5.9 parts of methoxypropanol serving as a solvent were charged in a sand mill using glass beads having a diameter of 1 mm, and dispersed for 3 hours to thereby prepare a dispersion liquid. In the dispersion liquid, 0.5 parts of a silicone resin particle serving as a surface roughing material (trade name: TOSPEARL 120, produced by GE Toshiba Silicones Co., Ltd., average particle diameter: 2 μm), and 0.001 parts of silicone oil serving as a leveling agent (trade name: SH28PA, produced by Dow Corning Toray Co., Ltd.) were added and stirred to thereby prepare a conductive layer coating liquid. This conductive layer coating liquid was dip-coated onto the support and then dried and heat-cured at 140° C. for 30 minutes, thereby forming a conductive layer having a thickness of 15 μm. Note that the thickness is an average thickness measured at a position 130 mm from the coating top of the support, and the same applies to the following description.

Next, 4 parts of an N-methoxymethylated nylon resin (trade name: TORESIN EF-30T, produced by Teikoku Chemical Industries Co., Ltd.) and 2 parts of a copolymer nylon resin (AMILAN CM8000, produced by Toray Industries, Inc.) were dissolved in a mixture solvent of 65 parts of methanol/30 parts of n-butanol, thereby preparing an undercoating layer coating liquid. This undercoating layer coating liquid was dip-coated onto the conductive layer and then dried at 100° C. for 10 minutes, thereby forming an undercoating layer having a thickness of 0.5 μm.

Next, 10 parts of a hydroxygallium phthalocyanine crystal of a crystal shape (charge generating material) having strong peaks at 7.5°, 9.9°, 16.3°, 18.6°, 25.1° and 28.3° of Bragg angles (2θ±0.2° in CuKα X-ray diffraction, 5 parts of polyvinylbutyral (trade name: ESLEC BX-1, produced by Sekisui Chemical Co., Ltd.) and 250 parts of cyclohexanone were charged in a sand mill using glass beads having a diameter of 1 mm, then dispersed for 1 hour, followed by adding 250 parts of ethyl acetate thereto, to thereby prepare a charge generation layer coating liquid. This charge generation layer coating liquid was dip-coated onto the undercoating layer and then dried at 100° C. for 10 minutes, thereby forming a charge generation layer having a thickness of 0.16 μm.

Next, 75 parts of a polycarbonate (Mv: 20,000, trade name: IUPILON Z200, produced by Mitsubishi Gas Chemical Company, Inc.) having a repeating structural unit represented by the following formula (2-2), (2-2)

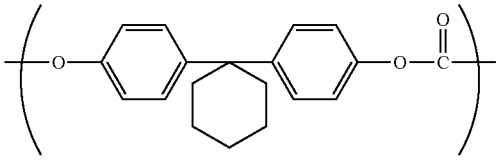

and 75 parts of a compound (charge transporting material) represented by the following formula (3-1)

(3-1)

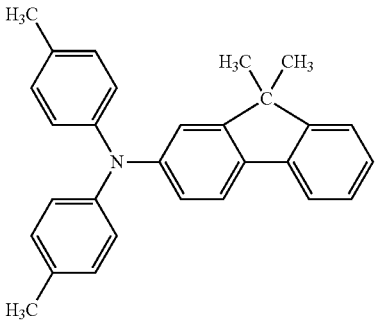

were dissolved in a mixed solvent of 500 parts of monochlorobenzene/100 parts of dimethoxymethane to thereby prepare a charge transport layer coating liquid. This charge transport layer coating liquid was dip-coated onto the charge generation layer and then dried at 120° C. for 1 hour, thereby forming a charge transport layer having a thickness of 15 μm.

Next, 15 parts of a polycarbonate (Mv: 20,000, trade name: IUPILON Z200, produced by Mitsubishi Gas Chemical Company, Inc.) having a repeating structural unit represented by the above formula (2-2) were dissolved in a mixed solvent of 500 parts of monochlorobenzene/100 parts of dimethoxymethane to thereby prepare a surface protective layer coating liquid. This polycarbonate is a resin having no structure to provide charge transporting performance. This surface protective layer coating liquid was spray-coated on the charge transport layer and then dried at 120° C. for 1 hour, thereby forming a surface protective layer having a thickness of 1.5 μm.

Figure 5:
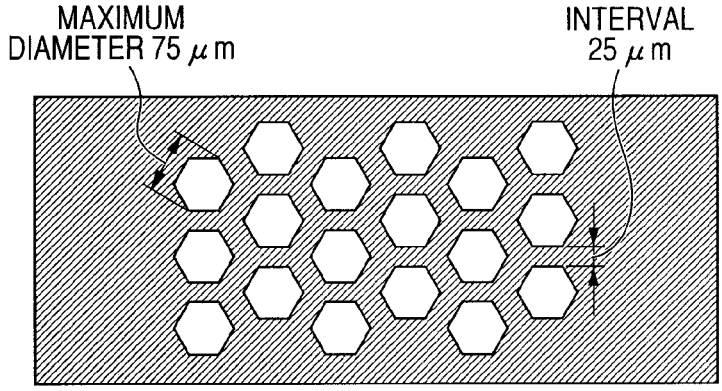
FIG. 5 is a partially enlarged diagram illustrating an array pattern made of a quartz glass mask used in Example 1.
Figure 6:
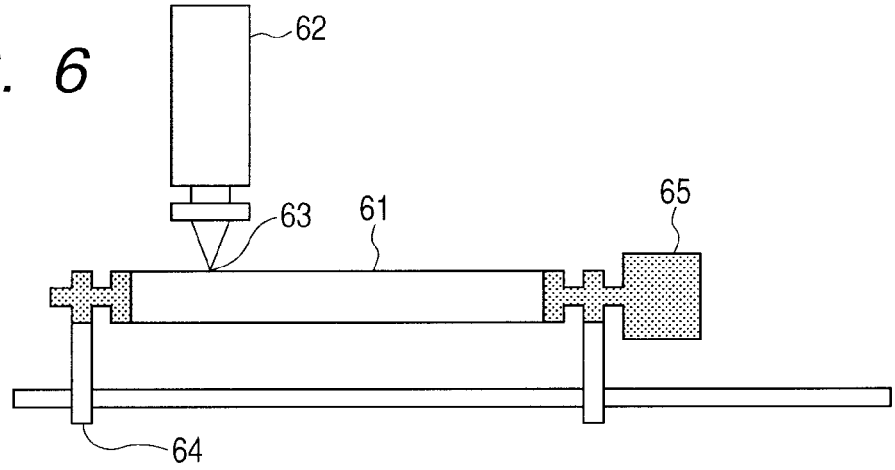
FIG. 6 is a schematic diagram illustrating a laser processing device for forming through holes.

Next, a plurality of through holes were formed in the surface protective layer using a KrF excimer laser (wavelength λ=248 nm, pulse width=17 ns). In the formation of the through holes, a quartz glass mask having a pattern, in which regular hexagonal column-shaped laser beam transmitting portions having a maximum diameter of 75 μm, as illustrated in FIG. 5, were arranged at an interval of 25 μm (opposite interval: 25 μm), was used. The irradiation energy of laser beam from the KrF excimer laser was 0.9 J/cm$^2$, and the laser beam irradiation area per one shot of the laser beam was 1.4 mm square (1.96 mm$^2$). In FIG. 5, the black color portion is a laser beam shield portion, and the white color portions are the laser beam transmitting portions. FIG. 6 illustrates a schematic construction of the laser processing device used for forming through holes. In FIG. 6, laser beam irradiation was performed over the surface of an electrophotographic photosensitive member 61 while the electrophotographic photosensitive member 61 was made to rotate and a laser beam irradiation position 63 of an excimer laser irradiation device (KrF excimer laser) 62 was shifted in the axial direction of the electrophotographic photosensitive member 61, thereby forming a plurality of through holes in the surface protective layer. Note that the laser processing device is equipped with a work moving device 64 and a work rotating motor 65.

In the above-mentioned manner, an electrophotographic photosensitive member was produced in which a conductive layer, an undercoating layer, a charge generation layer, a charge transport layer and a surface protective layer were formed in this order over a support, and a plurality of through holes were formed in the surface protective layer.

Figure 7:
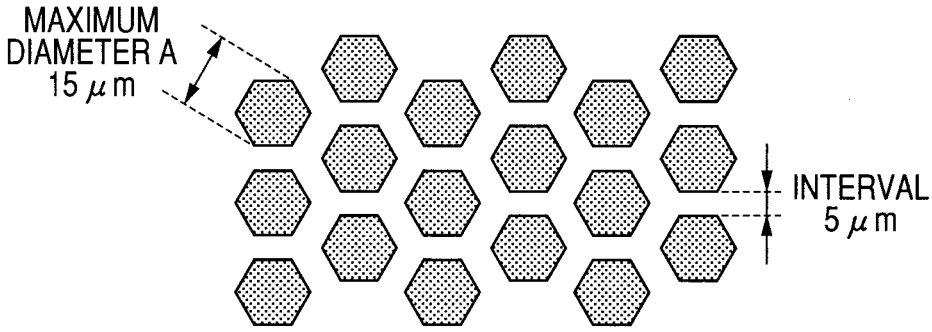
FIG. 7 is a partially enlarged diagram illustrating an array pattern of through holes formed in a surface protective layer of the electrophotographic photosensitive member of Example 1.

The surface of the produced electrophotographic photosensitive member was observed in the manner described above. Here, the observation was made at three different points, and substantially the same result was obtained in the observation points (the same applies to the following examples). In the observation, it was confirmed that regular hexagonal column-shaped through holes each having a maximum diameter A of 15 μm and a depth of 1.5 μm, as illustrated in FIG. 7, were formed at an interval of 5 μm (opposite interval: 5 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, two or more of the through holes were included in the exposure beam spot. In addition, 15 through holes or more were present per 100 μm square in the image forming area of the surface protective layer.

Evaluation

The produced electrophotographic photosensitive member was mounted in a copy machine remodeled from an electrophotographic copier including an exposure device of scanning exposure type, having a semiconductor laser (trade name: iRC6800) manufactured by Canon Inc., and the evaluation was carried out as follows. The exposure device was adjusted so that the spot of exposure beam applied to the surface of the electrophotographic photosensitive member therefrom had a minimum diameter of 40 μm and a maximum diameter of 50 μm. This copy machine was remodeled so that the electrophotographic photosensitive member was negatively charged.

Image Quality:

Under a normal-temperature/normal-humidity environment (23° C./50 RH %), the output resolution was set to 600 dpi, and a line-space image (one-line (thin line)-one-space image) and a halftone image were output. These output images were visually observed to evaluate the overall image quality thereof. Further, these output images were captured at a magnification of 100 times by an optical microscope, and the reproducibility of the lines and the halftone was evaluated. Note that the image quality of the output images was evaluated based on the following criteria. The evaluation results of image quality are shown in Table 1.

A: Line-broken portions, unevenness and a difference in image density are not observed in the line image, and also, irregular halftone dot arrangement and a difference in image density are not observed in the halftone image, and thus the output images are very clear.

B: The output images are almost clear, but line-broken portions and unevenness are observed in a small part of lines.

C: Line-broken portions, unevenness and a difference in image density are observed in a part of lines or as a whole of the line image. Irregular halftone dot arrangement and a difference in image density are observed in a part of halftone or as a whole of the halftone image, and thus, the output images are unclear.

Running Performance:

An image output running performance test using A4-size paper sheets was carried out under an intermittent output condition where 10 sheets of A4 size paper were intermittently output every five seconds. As a test chart, a chart having a printing ratio of 5% was used, with the proviso that among 10 sheets of the intermittent output, the test chart was printed on only one sheet, and a solid white image was printed on the rest 9 sheets. Note that the image output running performance test carried out by observing the surface of the electrophotographic photosensitive member after every printing of 100 sheets using a laser microscope (VK-9500, manufactured by Keyence Corporation) until the surface protective layer was abraded and disappeared. The total number of sheets output in this test was defined as the running performance. The results are shown in Table 1.

Charge Transporting Performance:

The degrees of charge transfer (charge transporting performance) of the charge transport layer and the surface protective layer were measured as described above. As a result of measurement, the degree of charge transfer of the charge transport layer was found to be $5\times10^{-6}$ $cm^2/V\cdot s$. It was impossible to measure the degree of charge transfer of the surface protective layer because the value was too small (the surface protective layer has no charge transporting performance). Also, the same value was found in the other Examples and Comparative Examples.

Example 2

An electrophotographic photosensitive member was produced in the same manner as in Example 1, except that a quartz glass mask having a different pattern was used instead of the quartz glass mask used in Example 1. The surface of the produced electrophotographic photosensitive member was observed in the same manner as in Example 1, and it was confirmed that regular hexagonal column-shaped through holes each having a maximum diameter of 15 μm and a depth of 1.5 μm were formed at an interval of 1 μm (opposite interval: 1 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 3

An electrophotographic photosensitive member was produced in the same manner as in Example 1, except that a quartz glass mask having a different pattern was used instead of the quartz glass mask used in Example 1. The surface of the produced electrophotographic photosensitive member was observed in the same manner as in Example 1, and it was confirmed that regular hexagonal column-shaped through holes each having a maximum diameter of 10 μm and a depth of 1.5 μm were formed at an interval of 3 μm (opposite interval: 3 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 4

An electrophotographic photosensitive member was produced in the same manner as in Example 1, except that a quartz glass mask having a different pattern was used instead of the quartz glass mask used in Example 1. The surface of the produced electrophotographic photosensitive member was observed in the same manner as in Example 1, and it was confirmed that regular hexagonal column-shaped through holes each having a maximum diameter of 5 μm and a depth of 1.5 μm were formed at an interval of 2 μm (opposite interval: 2 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 5

An electrophotographic photosensitive member was produced in the same manner as in Example 1, except that a quartz glass mask having a different pattern was used instead of the quartz glass mask used in Example 1. The surface of the produced electrophotographic photosensitive member was observed in the same manner as in Example 1, and it was confirmed that regular hexagonal column-shaped through holes each having a maximum diameter of 1 μm and a depth of 1.5 μm were formed at an interval of 1 μm (opposite interval: 1 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 6

An electrophotographic photosensitive member was produced in the same manner as in Example 5, except that the thickness of the surface protective layer was changed to 0.1 μm, and the irradiation energy of laser beam from the KrF excimer laser was changed to 0.1 J/cm$^2$. The surface of the produced electrophotographic photosensitive member was observed in the same manner as in Example 1, and it was confirmed that regular hexagonal column-shaped through holes each having a maximum diameter of 1 μm and a depth of 0.1 μm were formed at an interval of 1 μm (opposite interval: 1 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 7

An electrophotographic photosensitive member was produced in the same manner as in Example 2, except that a quartz glass mask having a different pattern was used instead of the quartz glass mask used in Example 2. The surface of the produced electrophotographic photosensitive member was observed in the same manner as in Example 1, and it was confirmed that regular hexagonal column-shaped through holes each having a maximum diameter of 16 μm and a depth of 1.5 μm were formed at an interval of 1 μm (opposite interval: 1 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 8

An electrophotographic photosensitive member was produced in the same manner as in Example 7, except that the thickness of the surface protective layer was changed to 0.1 μm, and the irradiation energy of laser beam from the KrF excimer laser was changed to 0.1 J/cm$^2$. The surface of the produced electrophotographic photosensitive member was observed in the same manner as in Example 1, and it was confirmed that regular hexagonal column-shaped through holes each having a maximum diameter of 16 μm and a depth of 0.1 μm were formed at an interval of 1 μm (opposite interval: 1 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 9

An electrophotographic photosensitive member was produced in the same manner as in Example 7, except that a quartz glass mask having a different pattern was used instead of the quartz glass mask used in Example 7. The surface of the produced electrophotographic photosensitive member was observed in the same manner as in Example 1, and it was confirmed that regular hexagonal column-shaped through holes each having a maximum diameter of 20 μm and a depth of 1.5 μm were formed at an interval of 1 μm (opposite interval: 1 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 10

An electrophotographic photosensitive member was produced in the same manner as in Example 8, except that a quartz glass mask having a different pattern was used instead of the quartz glass mask used in Example 8. The surface of the produced electrophotographic photosensitive member was observed in the same manner as in Example 1, and it was confirmed that regular hexagonal column-shaped through holes each having a maximum diameter of 20 μm and a depth of 0.1 μm were formed at an interval of 1 μm (opposite interval: 1 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Examples 11 to 16

Electrophotographic photosensitive members were produced in the same manner as in Examples 5 to 10, respectively, except that each of the electrophotographic photosensitive members was adjusted so that a spot of exposure beam applied to the surface of the electrophotographic photosensitive member therefrom had a minimum diameter of 50 μm and a maximum diameter of 60 μm. The produced electrophotographic photosensitive members were each evaluated in the same manner as in Example 1. The evaluation results are shown in Table 1.

Comparative Example 1

An electrophotographic photosensitive member was produced in the same manner as in Example 1, except that through holes were not formed in the surface protective layer. This electrophotographic photosensitive member was evaluated in the same manner as in Example 1. The evaluation results are shown in Table 1.

Comparative Example 2

An electrophotographic photosensitive member was produced in the same manner as in Example 1, except that a quartz glass mask having a different pattern was used instead of the quartz glass mask used in Example 1. The surface of the produced electrophotographic photosensitive member was observed in the same manner as in Example 1, and it was confirmed that regular hexagonal column-shaped through holes each having a maximum diameter of 50 μm and a depth of 1.5 μm were formed at an interval of 50 μm (opposite interval: 50 μm) in the surface protective layer. This pattern shape was such a shape that when an exposure beam was applied to the surface of the electrophotographic photosensitive member so that the minimum diameter of the beam spot was 40 μm and the maximum diameter thereof was 50 μm, only at most one through hole was included in the exposure beam spot. In addition, seven through holes or less were present per 100 μm square in the image forming area of the surface protective layer. This electrophotographic photosensitive member was evaluated in the same manner as in Example 1. The evaluation results are shown in Table 1.

Comparative Example 3

An electrophotographic photosensitive member was produced in the same manner as in Example 1, except that a quartz glass mask having a different pattern was used instead of the quartz glass mask used in Example 1. The surface of the produced electrophotographic photosensitive member was observed in the same manner as in Example 1, and it was confirmed that cylindrical-shaped through holes each having a diameter of 2 μm and a depth of 1.5 μm were formed with a central clearance of 42 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, only at most one through hole was included in the exposure beam spot. In addition, seven through holes or less were present per 100 μm square in the image forming area of the surface protective layer. This electrophotographic photosensitive member was evaluated in the same manner as in Example 1. The evaluation results are shown in Table 1.

Example 17

A conductive layer, an undercoating layer, a charge generation layer, and a charge transport layer were formed in this order over a support in the same manner as in Example 1.

Next, 625 parts of monochlorobenzene, 1,455 parts of dimethoxymethane, 25 parts of triethylene glycol, 25 parts of tetrahydrofurfuryl alcohol, and 85 parts of polyarylate (aromatic polyester, Mw: 120,000; molar ratio of terephthalic acid structure to isophthalic acid structure: 50:50) having a repeating structural unit represented by the following formula (2-1) were mixed to dissolve the polyarylate, thereby preparing a surface protective layer coating liquid.

(2-1)

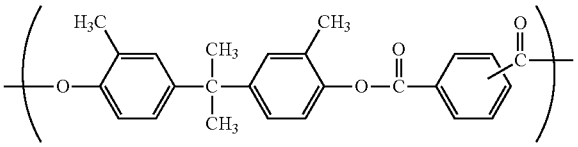

This polyarylate is a resin having no structure to provide charge transporting performance. The surface protective layer coating liquid was spray-coated on the charge transport layer. After that, the support coated on its outer surface with the surface protective layer coating liquid was left at rest under a normal-temperature/normal-humidity environment (23° C./50 RH %) for 3 minutes, and thereby a plurality of through holes were formed in the coating of the surface protective layer coating liquid. Next, the coating of the surface protective layer coating liquid having the plurality of through holes formed on the surface thereof was dried at 120° C. for 1 hour, thereby forming a surface protective layer having a thickness of 0.1 μm.

In the above-mentioned manner, an electrophotographic photosensitive member was produced in which a conductive layer, an undercoating layer, a charge generation layer, a charge transport layer and a surface protective layer were formed in this order over a support, and a plurality of through holes were formed in the surface protective layer.

The surface of the produced electrophotographic photosensitive member was observed in the same manner as in Example 1, and it was confirmed that cylindrical-shaped through holes each having a diameter of 3 μm and a depth of 0.1 μm, as illustrated in FIG. 9, were formed with a central clearance of 4 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 18

An electrophotographic photosensitive member was produced in the same manner as in Example 17, except that the thickness of the surface protective layer in Example 17 was changed to 0.5 μm. The surface of the produced electrophotographic photosensitive member was observed in the same manner as in Example 1, and it was confirmed that cylindrical-shaped through holes each having a diameter of 3 μm and a depth of 0.5 μm were formed with a central clearance of 4 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 19

An electrophotographic photosensitive member was produced in the same manner as in Example 17, except that the thickness of the surface protective layer was changed to 1.0 μm. The surface of the produced electrophotographic photosensitive member was observed in the same manner as in Example 1, and it was confirmed that cylindrical-shaped through holes each having a diameter of 3 μm and a depth of 1.0 μm were formed with a central clearance of 4 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 20

An electrophotographic photosensitive member was produced in the same manner as in Example 17, except that the thickness of the surface protective layer was changed to 1.5 μm. The surface of the produced electrophotographic photosensitive member was observed in the same manner as in Example 1, and it was confirmed that cylindrical-shaped through holes each having a diameter of 3 μm and a depth of 1.5 μm were formed with a central clearance of 4 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Comparative Example 4

A conductive layer, an undercoating layer, a charge generation layer, and a charge transport layer were formed in this order over a support in the same manner as in Example 1.

Next, 85 parts of polyarylate (aromatic polyester, Mw: 120,000; molar ratio of terephthalic acid structure to isophthalic acid structure: 50:50) having a repeating structural unit represented by the above formula (2-1) and 34 parts of a compound (charge transporting material) represented by the above formula (3-1) were dissolved in a mixed solvent of 625 parts of monochlorobenzene/1,455 parts of dimethoxymethane to thereby prepare a surface protective layer coating liquid. The surface protective layer coating liquid was spray-coated on the charge transport layer and then dried at 120° C. for 1 hour, thereby forming a surface protective layer having a thickness of 0.1 μm. This surface protective layer may also be called a second charge transport layer.

In the above-mentioned manner, an electrophotographic photosensitive member was produced in which a conductive layer, an undercoating layer, a charge generation layer, a charge transport layer and a surface protective layer were formed in this order over a support.

This electrophotographic photosensitive member was evaluated in the same manner as in Example 1. The evaluation results are shown in Table 1.

Comparative Example 5

An electrophotographic photosensitive member was produced in the same manner as in Example 17, except that the thickness of the surface protective layer was changed to 1.7 μm. The surface of the produced electrophotographic photosensitive member was observed in the same manner as in Example 1, and it was confirmed that cylindrical-shaped through holes each having a diameter of 3 μm and a depth of 1.7 μm were formed with a central clearance of 4 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Comparative Example 6

An electrophotographic photosensitive member was produced in the same manner as in Example 17, except that the thickness of the surface protective layer was changed to 2.0 μm. The surface of the produced electrophotographic photosensitive member was observed in the same manner as in Example 1, and it was confirmed that cylindrical-shaped through holes each having a diameter of 3 μm and a depth of 2.0 μm were formed with a central clearance of 4 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 21

An electrophotographic photosensitive member was produced in the same manner as in Example 17, except that 2 parts of 2,6-bis(1,1-dimethylethyl)-4-methylphenol (antioxidant) was further added to the surface protective layer coating liquid, and the thickness of the surface protective layer was changed to 1.0 μm. The surface of the produced electrophotographic photosensitive member was observed in the same manner as in Example 1, and it was confirmed that cylindrical-shaped through holes each having a diameter of 3 μm and a depth of 1.0 μm were formed with a central clearance of 4 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 22

An electrophotographic photosensitive member was produced in the same manner as in Example 17, except that 10 parts of a hydrophobized silica powder (trade name: KMPX-100, average particle diameter: 0.1 μm, produced by Shin-Etsu Chemical Co., Ltd.) was further added to the surface protective layer coating liquid, and the thickness of the surface protective layer was changed to 1.0 μm. The surface of the produced electrophotographic photosensitive member was observed in the same manner as in Example 1, and it was confirmed that cylindrical-shaped through holes each having a diameter of 3 μm and a depth of 1.0 μm were formed with a central clearance of 4 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 23

A conductive layer, an undercoating layer, a charge generation layer, and a charge transport layer were formed in this order over a support in the same manner as in Example 1.

Next, 30 parts of neopentylglycol-modified trimethylolpropane diacrylate (trade name: KAYARAD R604, produced by Nippon Kayaku Co., Ltd.) were dissolved in 300 parts of 1-propanol to thereby prepare a surface protective layer coating liquid. This surface protective layer coating liquid was dip-coated onto the charge transport layer and then subjected to heating at 50° C. for 10 minutes. After that, the support coated on its outer surface with the surface protective layer coating liquid was left at rest under a high-temperature/high-humidity environment (70° C./90 RH %) for 3 minutes, and thereby a plurality of through holes were formed in the coating of the surface protective layer coating liquid. Next, the coating of the surface protective layer coating liquid having the plurality of through holes formed on the surface thereof was irradiated with an electron beam for 1.6 seconds in a nitrogen atmosphere while the cylinder being rotated at 200 rpm under conditions of an acceleration voltage of 150 kV, a beam current of 3.0 mA. Subsequently, in the nitrogen atmosphere, the coating of the surface protective layer coating liquid was subjected to a heat curing reaction by increasing the temperature thereof from 25° C. to 125° C. over 30 seconds. Note that the oxygen concentration of the atmosphere employed in the electron beam irradiation and the heat curing reaction was 15 ppm or lower. After that, the coating of the surface protective layer coating liquid was left in the air to be naturally cooled to 25° C., and then subjected to heating at 100° C. for 30 minutes, thereby forming a surface protective layer having a thickness of 1.0 μm.

In the above-mentioned manner, an electrophotographic photosensitive member was produced in which a conductive layer, an undercoating layer, a charge generation layer, a charge transport layer and a surface protective layer were formed in this order over a support, and a plurality of through holes were formed in the surface protective layer.

The surface of the produced electrophotographic photosensitive member was observed in the same manner as in Example 1, and it was confirmed that cylindrical-shaped through holes each having a diameter of 5 μm and a depth of 1.0 μm were formed with a central clearance of 6 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 24

An electrophotographic photosensitive member was produced in the same manner as in Example 23, except that 30 parts of neopentylglycol-modified trimethylolpropane diacrylate used in preparation of the surface protective layer coating liquid was changed to 30 parts of trimethylolpropane triacrylate (trade name: KAYARAD TMPTA, produced by Nippon Kayaku Co., Ltd.). The surface of the produced electrophotographic photosensitive member was observed in the same manner as in Example 1, and it was confirmed that cylindrical-shaped through holes each having a diameter of 5 μm and a depth of 1.0 μm were formed with a central clearance of 6 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 through holes or more were present per 100 μm square in the image forming area of the surface protective layer. This electrophotographic photosensitive member was evaluated in the same manner as in Example 1. The evaluation results are shown in Table 1.

Example 25

An electrophotographic photosensitive member was produced in the same manner as in Example 23, except that 30 parts of neopentylglycol-modified trimethylolpropane diacrylate used in preparation of the surface protective layer coating liquid was changed to 30 parts of dipentaerythritol hexaacrylate (trade name: KAYARAD DPHA, produced by Nippon Kayaku Co., Ltd.). The surface of the produced electrophotographic photosensitive member was observed in the same manner as in Example 1, and it was confirmed that cylindrical-shaped through holes each having a diameter of 5 μm and a depth of 1.0 μm were formed with a central clearance of 6 μm in the surface protective layer. This pattern shape was such a shape that when an exposure beam was applied to the surface of the electrophotographic photosensitive member so that the minimum diameter of the beam spot was 40 μm and the maximum diameter thereof was 50 μm, five through holes or more were included in the exposure beam spot. In addition, 35 or more of the through holes were present per 100 μm square in the image forming area of the surface protective layer. This electrophotographic photosensitive member was evaluated in the same manner as in Example 1. The evaluation results are shown in Table 1.

Comparative Example 7

An electrophotographic photosensitive member was produced in the same manner as in Example 23, except that through holes were not formed in the coating of the surface protective layer. This electrophotographic photosensitive member was evaluated in the same manner as in Example 1. The evaluation results are shown in Table 1.

Comparative Example 8

An electrophotographic photosensitive member was produced in the same manner as in Example 24, except that through holes were not formed in the coating of the surface protective layer. This electrophotographic photosensitive member was evaluated in the same manner as in Example 1. The evaluation results are shown in Table 1.

Comparative Example 9

An electrophotographic photosensitive member was produced in the same manner as in Example 25, except that through holes were not formed in the coating of the surface protective layer. This electrophotographic photosensitive member was evaluated in the same manner as in Example 1. The evaluation results are shown in Table 1.

Comparative Example 10

A conductive layer, an undercoating layer, a charge generation layer, and a charge transport layer were formed in this order over a support in the same manner as in Example 1.

Next, 15 parts of a polycarbonate (Mv: 20,000, trade name: IUPILON 2200, produced by Mitsubishi Gas Chemical Company, Inc.) having a repeating structural unit represented by the above formula (2-2) and 15 parts of a compound (charge transporting material) represented by the above formula (3-1) were dissolved in a mixed solvent of 500 parts of monochlorobenzene/100 parts of dimethoxymethane to thereby prepare a surface protective layer coating liquid. The surface protective layer coating liquid was spray-coated on the charge transport layer and then dried at 120° C. for 1 hour, thereby forming a surface protective layer having a thickness of 1.5 μm. This surface protective layer may also be called a second charge transport layer.

In the above-mentioned manner, an electrophotographic photosensitive member was produced in which a conductive layer, an undercoating layer, a charge generation layer, a charge transport layer and a surface protective layer were formed in this order over a support.

This electrophotographic photosensitive member was evaluated in the same manner as in Example 1. The evaluation results are shown in Table 1.

Note that the viscosity average molecular weight (Mv) and weight average molecular weight (Mw) in the present invention were measured according to the following methods.

Measurement Method of Viscosity Average Molecular Weight (Mv):

A resin (0.5 g) as a measurement target was dissolved in 100 ml of methylene chloride, and a relative viscosity at 25° C. of the mixture solution was measured using an improved Ubbelohde type viscometer. Next, a limiting viscosity thereof was determined from the relative viscosity, and a viscosity average molecular weight (Mv) of the resin as a measurement target was calculated by a Mark-Houwink viscosity equation. The viscosity average molecular weight (Mv) was determined as a polystyrene equivalent value measured by gel permeation chromatography (GPC).

Measurement Method of Weight Average Molecular Weight (Mw):

A resin as a measurement target was placed in tetrahydrofuran and left standing for several hours. After that, the measurement-target resin and tetrahydrofuran were mixed well while being shaken (mixed until no aggregate of the measuring-target resin was observed) followed by further allowing to stand for 12 hours or more. After that, a mixture product which had been passed through a sample-treating filter, MAISHORIDISK H-25-5 manufactured by Tosoh Corporation, was provided as a sample for gel permeation chromatography (GPC). Subsequently, the column was stabilized in a heat chamber at 40° C., and a solvent, tetrahydrofuran, was then fed at a flow rate of 1 ml/min to the column at the temperature. Subsequently, 10 μl of the GPC sample was injected into the column, thereby determining the weight average molecular weight (Mw) of the measuring-target resin. As the column, a column (TSKgel SuperHM-M manufactured by Tosoh Corporation) was used. For determining the weight average molecular weight (Mw) of the measuring-target resin, a molecular weight distribution possessed by the measuring-target resin was calculated from a relationship between the logarithmic values of the calibration curve prepared by several monodispersed polystyrene standard samples and the counted values. The standard polystyrene samples used for preparing the calibration curve were monodispersed polystyrene produced by Sigma-Aldrich Corporation of ten different molecular weights: 3,500; 12,000; 40,000; 75,000; 98,000; 120,000; 240,000; 500,000; 800,000; and 1,800,000. The detector used was an RI (refraction index) detector.

TABLE 1

| | Electrophotographic photosensitive member | | | | | | |
|---|---|---|---|---|---|---|---|
| | Exposure device Minimum diameter of exposure | Thickness of surface protective | Maximum diameter of through holes in surface protective layer | The number of through holes included in exposure beam | Image quality (reproducibility) | | Running |
| No. | beam spot (B) | layer | (A) | spot | Line | Halftone | Performance |
| Ex. 1 | 40 μm | 1.5 μm | 15 μm | 2 or more | B | B | 5500 sheets |
| Ex. 2 | 40 μm | 1.5 μm | 15 μm | 5 or more | A | A | 5400 sheets |
| Ex. 3 | 40 μm | 1.5 μm | 10 μm | 5 or more | A | A | 5300 sheets |
| Ex. 4 | 40 μm | 1.5 μm | 5 μm | 5 or more | A | A | 5100 sheets |
| Ex. 5 | 40 μm | 1.5 μm | 1 μm | 5 or more | A | A | 5000 sheets |
| Ex. 6 | 40 μm | 0.1 μm | 1 μm | 5 or more | A | A | 300 sheets |
| Ex. 7 | 40 μm | 1.5 μm | 16 μm | 5 or more | A | A | 5400 sheets |
| Ex. 8 | 40 μm | 0.1 μm | 16 μm | 5 or more | A | A | 350 sheets |
| Ex. 9 | 40 μm | 1.5 μm | 20 μm | 5 or more | B | B | 5600 sheets |
| Ex. 10 | 40 μm | 0.1 μm | 20 μm | 5 or more | B | B | 370 sheets |
| Ex. 11 | 50 μm | 1.5 μm | 1 μm | 5 or more | A | A | 5000 sheets |
| Ex. 12 | 50 μm | 0.1 μm | 1 μm | 5 or more | A | A | 300 sheets |
| Ex. 13 | 50 μm | 1.5 μm | 16 μm | 5 or more | A | A | 5400 sheets |

TABLE 1-continued

| | Exposure device Minimum diameter of exposure | Electrophotographic photosensitive member Thickness of surface protective | Maximum diameter of through holes in surface protective layer | The number of through holes included in exposure beam | Image quality (reproducibility) | | Running |
|---|---|---|---|---|---|---|---|
| No. | beam spot (B) | layer | (A) | spot | Line | Halftone | Performance |
| Ex. 14 | 50 μm | 0.1 μm | 16 μm | 5 or more | A | A | 350 sheets |
| Ex. 15 | 50 μm | 1.5 μm | 20 μm | 5 or more | A | A | 5600 sheets |
| Ex. 16 | 50 μm | 0.1 μm | 20 μm | 5 or more | A | A | 370 sheets |
| Ex. 17 | 40 μm | 0.1 μm | 3 μm | 5 or more | A | A | 700 sheets |
| Ex. 18 | 40 μm | 0.5 μm | 3 μm | 5 or more | A | A | 3300 sheets |
| Ex. 19 | 40 μm | 1.0 μm | 3 μm | 5 or more | A | A | 6700 sheets |
| Ex. 20 | 40 μm | 1.5 μm | 3 μm | 5 or more | A | A | 10000 sheets |
| Ex. 21 | 40 μm | 1.0 μm | 3 μm | 5 or more | A | A | 6500 sheets |
| Ex. 22 | 40 μm | 1.0 μm | 3 μm | 5 or more | A | A | 8500 sheets |
| Ex. 23 | 40 μm | 1.0 μm | 5 μm | 5 or more | A | A | 170000 sheets |
| Ex. 24 | 40 μm | 1.0 μm | 5 μm | 5 or more | A | A | 700000 sheets |
| Ex. 25 | 40 μm | 1.0 μm | 5 μm | 5 or more | A | A | 1400000 sheets |
| Com. Ex. 1 | 40 μm | 1.5 μm | — | — | C | C | 7000 sheets |
| Com. Ex. 2 | 40 μm | 1.5 μm | 50 μm | at most one | C | C | 6500 sheets |
| Com. Ex. 3 | 40 μm | 1.5 μm | 2 μm | at most one | C | C | 6200 sheets |
| Com. Ex. 4 | 40 μm | 0.1 μm | — | — | A | A | 200 sheets |
| Com. Ex. 5 | 40 μm | 1.7 μm | 3 μm | 5 or more | C | C | 10200 sheets |
| Com. Ex. 6 | 40 μm | 2.0 μm | 3 μm | 5 or more | C | C | 10500 sheets |
| Com. Ex. 7 | 40 μm | 1.0 μm | — | — | C | C | 185000 sheets |
| Com. Ex. 8 | 40 μm | 1.0 μm | — | — | C | C | 750000 sheets |
| Com. Ex. 9 | 40 μm | 1.0 μm | — | — | C | C | 1500000 sheets |
| Com. Ex. 10 | 40 μm | 1.5 μm | — | — | A | A | 1500 sheets |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-199499, filed Aug. 31, 2009, and Japanese Patent Application No. 2010-188397, filed Aug. 25, 2010, which are hereby incorporated by reference herein in their entirety.

The invention claimed is:

1. An electrophotographic apparatus comprising:

an electrophotographic photosensitive member which comprises a support, a charge generation layer formed on the support and containing a charge generating material, a charge transport layer formed on the charge generation layer and containing a charge transporting material, and a surface protective layer formed on the charge transport layer; and an exposure device which irradiates a surface of the electrophotographic photosensitive member with an exposure beam based on image information so as to form an electrostatic latent image on the surface of the electrophotographic photosensitive member, wherein the surface protective layer comprises a material having no structure to provide charge transporting performance and has a plurality of through holes penetrating from the side of the front surface of the surface protective layer to the side of the charge transport layer, and the thickness of the surface protective layer is from 0.1 μm or more to 1.5 μm or less, and wherein when the surface of the electrophotographic photosensitive member is irradiated with the exposure beam, two or more of the through holes are included in an exposure beam spot.

2. The electrophotographic apparatus according to claim 1, wherein when the surface of the electrophotographic photosensitive member is irradiated with the exposure beam, at least five of the through holes are included in the exposure beam spot.

3. The electrophotographic apparatus according to claim 1, wherein a maximum diameter A [μm] of the through holes and a minimum diameter B [μm] of the exposure beam spot satisfy a relationship represented by the following Expression (1):

$$1 \leqq A \leqq B \times 0.4 \quad (1).$$

* * * * *